United States Patent [19]

Sugasawa et al.

[11] 4,337,740

[45] Jul. 6, 1982

[54] INTERNAL COMBUSTION ENGINE

[75] Inventors: Fukashi Sugasawa, Yokohama; Haruhiko Iizuka, Yokosuka; Yukihiro Etoh, Kandaiji; Toshiaki Tanaka, Fujisawa, all of Japan

[73] Assignee: Nissan Motor Company, Limited, Yokohama, Japan

[21] Appl. No.: 160,564

[22] Filed: Jun. 18, 1980

[30] Foreign Application Priority Data

Jun. 22, 1979 [JP] Japan ..... 54-78701

[51] Int. Cl.[3] ..... F02D 17/00

[52] U.S. Cl. ..... 123/198 F; 123/481; 123/568

[58] Field of Search ..... 123/481, 198 F, 568 R; 60/276, 285

[56] References Cited

U.S. PATENT DOCUMENTS

| | | | |
|---|---|---|---|
| 2,918,047 | 12/1959 | Mick | 123/198 F |
| 4,064,844 | 12/1977 | Matsumoto et al. | 123/198 F |
| 4,107,921 | 8/1978 | Iizuka | 123/198 F |
| 4,201,180 | 5/1980 | Iizuka | 123/481 |
| 4,245,471 | 1/1981 | Sugasawa et al. | 123/198 F |
| 4,276,863 | 7/1981 | Sugasawa et al. | 123/198 F |

*Primary Examiner*—P. S. Lall

*Attorney, Agent, or Firm*—Schwartz, Jeffery, Schwaab, Mack, Blumenthal & Koch

[57] ABSTRACT

An internal combustion engine is disclosed which includes active and inactive cylinders, a load detector adapted to provide a low load indicative signal when the engine load is below a predetermined value, first means responsive to the low load indicative signal for cutting off the flow of air to the inactive cylinders, and second means for supplying a controlled amount of fuel into the active and inactive cylinders so as to achieve a somewhat lean air-fuel mixture therein. The second means is responsive to the low load indicative signal for cutting off the supply of fuel to the inactive cylinders and increasing the amount of fuel supplied to the active cylinders so as to achieve a somewhat rich air-fuel mixture therein. Third means is provided for monitoring the oxygen content of the exhaust from the engine to control the second means so that the fuel supplied to the engine is correct to maintain the stoichiometric air/fuel ratio.

3 Claims, 2 Drawing Figures

INTERNAL COMBUSTION ENGINE

BACKGROUND OF THE INVENTION

1. Field of the Invention

This invention relates to improvements in an internal combustion engine of the split type operable on less than all of its cylinders when the engine load is below a given value.

2. Description of the Prior Art

In general, internal combustion engines demonstrate higher efficiency and thus higher fuel economy when running under higher load conditions. In view of this fact, split type internal combustion engines have already been proposed which have active cylinders which are always active and inactive cylinders which are inactive when the engine load is below a given value. Such split engines have an intake passage divided into first and second branches, the first branch being associated with the active cylinders and the second branch being associated with the inactive cylinders and in which there is provided a stop valve. In the present invention, a split engine operating system is provided which is responsive to a drop in the engine load below a given value to close the stop valve in the second branch of the intake passage so as to cut off the flow of air to the inactive cylinders and also to cut off the flow of fuel to the inactive cylinders while doubling the amount of fuel supplied to the active cylinders so as to shift the engine into a split engine mode of operation where the engine operates only on the active cylinders. This increases active cylinder loads, resulting in higher fuel economy.

One difficulty with such split type internal combustion engines is that a sudden torque change occurs which imparts a jolt to the passenger when the engine operation is shifted between the split and full engine modes. It is conventional practice to change the air/fuel ratio when the engine operation is shifted between the split and full engine modes so as to suppress such a torque change. However, this requires a special circuit for controlling the air/fuel ratio when the engine mode is changed.

SUMMARY OF THE INVENTION

It is, therefore, one object of the present invention to provide a split internal combustion engine with a simple device for minimizing shock resulting from sudden torque changes occurring when the engine operation is shifted between its split and full engine modes.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The present invention will be described in greater detail by reference to the following description taken on connection with the accompanying drawings, in which.

DESCRIPTION OF THE PREFERRED EMBODIMENT

Figure 1:
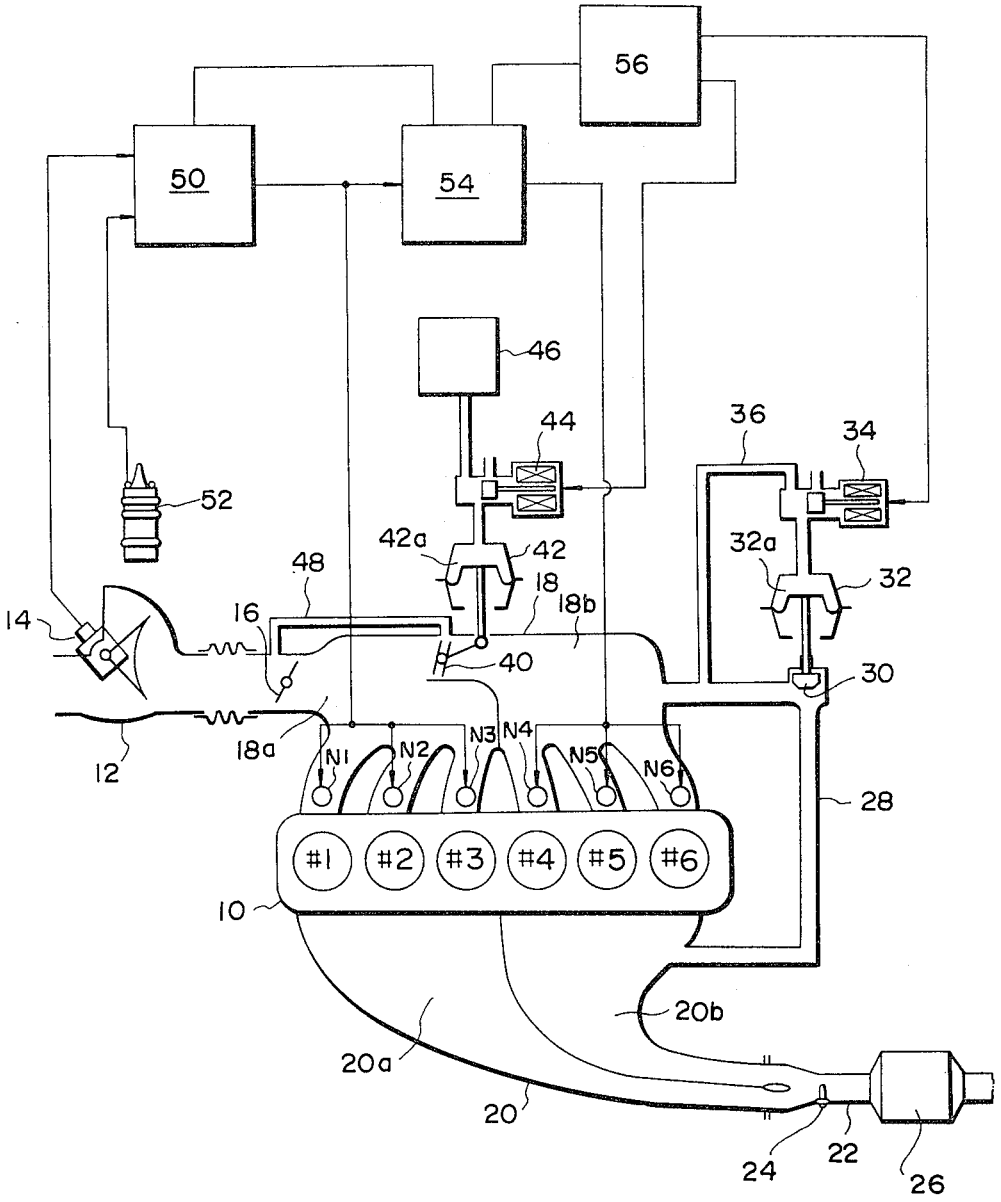
FIG. 1 is a schematic view showing one embodiment of split engine constructed in accordance with the present invention.

Referring now to FIG. 1, the reference numeral 10 designates an engine block containing therein an active cylinder unit including three cylinders #1 to #3 being always active and an inactive cylinder unit having three cylinders #4 to #6 being inactive when the engine load is below a predetermined value. Air is supplied to the engine through an air induction passage 12 provided therein with an airflow meter 14 and a throttle valve 16 drivingly connected to the accelerator pedal (not shown) for controlling the flow of air to the engine. The induction passage 12 is connected downstream of the throttle valve 16 to an intake manifold 18 which is divided into first and second intake passages 18*a* and 18*b*. The first intake passage 18*a* leads to the active cylinders #1 to #3 and the second intake passage 18*b* leads to the inactive cylinders #4 to #6.

The engine also has an exhaust manifold 20 which is divided into first and second exhaust passages 20*a* and 20*b* leading from the active cylinders #1 to #3 and the inactive cylinders #4 to #6, respectively. The exhaust manifold 20 is connected at its downstream end to an exhaust duct 22 provided therein with an exhaust gas sensor 24 and an exhaust gas purifier 26 located downstream of the exhaust gas sensor 24. The exhaust gas sensor 24 may be in the form of an oxygen sensor which monitors the oxygen content of the exhaust and is effective to provide a signal indicative of the air/fuel ratio at which the engine is operating. The exhaust gas purifier 26 may be in the form of a three-way catalytic converter which effects oxidation of HC and CO and reduction of NOx so as to minimize the emission of pollutants passing through the exhaust duct 22. The catalytic converter exhibits its maximum performance at the stoichiometric air/fuel ratio. In view of this, it is preferable to maintain the air/fuel ratio at the stoichiometric value.

An exhaust gas recirculation (EGR) passage 28 is provided which has its one end opening into the second exhaust passage 20*b* and the other end thereof opening into the second intake passage 18*b*. The EGR passage 28 has therein an EGR valve 30 which is normally closed and is open to allow recirculation of exhaust gases from the second exhaust passage 20*b* into the second intake passage 18*b* so as to minimize pumping losses in the inactive cylinders #4 to #6 during a split engine mode of operation.

The EGR valve 30 is driven by a first pneumatic valve actuator 32 which includes a diaphragm spreaded within a casing to define therewith two chambers on the opposite sides of the diaphragm, and an operating rod having its one end centrally fixed to the diaphragm and the other end thereof drivingly connected to the EGR valve 30. The working chamber 32*a* is connected to the outlet of a first three-way solenoid valve 34 which has an atmosphere inlet communicated with atmospheric air and a vacuum inlet connected through a conduit 36 to the second intake passage 18*b*. The first solenoid valve 34 is normally in a position providing communication of atmospheric pressure to the working chamber 32*a* of the first valve actuator 32 so as to close the EGR valve 30. When the engine operation is shifted from a full engine mode into a split engine mode, the first solenoid valve 34 is responsive to a valve drive signal from a valve drive circuit to be described later to move to another position where communication is established between the second intake passage 18*b* and the working chamber 32*a* of the first valve actuator 32, thereby opening the EGR valve 30. As vacuum decreases in the second intake passage 18*b*, the opening of the EGR valve 30 decreases to reduce the amount of exhaust gases recirculated through the EGR passage 28. This increases the vacuum in the second intake passage 18*b* with pumping in the inactive cylinders #4 to #6 to increase the opening of the EGR valve 30. As a result, the vacuum in the second intake passage 18*b* can be maintained at a predetermined weak vacuum without reaching the atmospheric pressure during a split engine mode of operation.

The second intake passage 18*b* is provided at its entrance with a stop valve 40. The stop valve 40 is driven by a second pneumatic valve actuator 42 which is substantially similar in structure to the first valve actuator 32. The working chamber 42*a* of the second valve actuator 42 is connected to the outlet of a second three-way solenoid valve 44 which has an atmosphere inlet communicated with atmospheric air and a vacuum inlet connected to a vacuum tank 46. The second solenoid valve 44 is normally in a position providing communication of atmospheric pressure to the working chamber 42*a* of the second valve actuator 42 so as to open the stop valve 40. In response to the valve drive signal from a valve drive circuit to be described later, the first solenoid valve 44 moves to another position where communication is established between the vacuum tank 46 and the working chamber 42*a* of the second valve actuator 42 so as to close the stop valve 20, thereby stopping the flow of air into the inactive cylinders #4 to #6 and precluding escape of exhaust gases charged in the second intake passage 18*b* into the first intake passage 18*a*.

The stop valve 40 may be in the form of a doublefaced butterfly valve having a pair of valve plates facing in spaced-parallel relation to each other. A conduit 48 is provided which has its one end opening into the induction passage 12 at a point upstream of the throttle valve 16 and the other end thereof opening into the second intake passage 18*b*, the other end being in registry with the space between the valve plates when the stop valve 40 is at its closed position. Air, which is substantially at atmospheric pressure, is introduced through the conduit 48 into the space between the valve plates so as to ensure that the exhaust gases charged in the second intake passage 18*b* can not escape into the first intake passage 18*a* when the stop valve 40 is closed.

An injection control circuit 50 is provided which is adapted to provide, in synchronism with engine speed such as represented by spark pulses from an ignition coil 52, a fuel-injection pulse signal of pulse width proportional to the air flow rate sensed by the airflow meter 14 and corrected in accordance with an air/fuel ratio indicative signal from the exhaust gas sensor 24. The fuel-injection pulse signal is applied directly to fuel injection valves N1 to N3 for supplying fuel to the respective cylinders #1 to #3 and also through a split engine operating circuit 54 to fuel injection valves N4 to N6 for supplying fuel to the respective inactive cylinders #4 to #6. Each of the fuel injection valves N1 to N6 may be in the form of an ON-OFF type solenoid valve adapted to open for a period corresponding to the pulse width of the fuel-injection pulse signal.

The split engine operating circuit 54 determines the load at which the engine is operating from the pulse width of the fuel injection pulse signal. At high load conditions, the split engine operating circuit 54 allows the passage of the fuel-injection pulse signal to the fuel injection valves N4 to N6 and provides a high load indicative signal to a valve drive circuit 56. The valve drive circuit 56 is responsive to the high load indicative signal from the split engine operating circuit 54 to hold the first and second three-way valves 34 and 44 in their normal positions and as a result the EGR valve 30 is closed and the stop valve 40 is open to allow the flow of air into the inactive cylinders #4 to #6. Accordingly, the engine is placed in a full engine mode of operation.

When the engine load falls below a given value, the split engine operating circuit 54 cuts off the flow of fuel-injection pulse signal to the fuel injection valves N4 to N6 and provides a low load indicative signal to the valve drive circuit 56. The valve drive circuit 56 is responsive to the low load indicative signal to provide valve drive signals to the first and second three-way valves 34 and 44. As a result, the first three-way valve 34 provides communication between the second intake passage 18*b* and the working chamber 32*a* of the first valve actuator 32 so as to open the EGR valve 30 to allow recirculation of exhaust gases through the EGR passage 28. Simultaneously, the second three-way valve 44 provides communication between the vacuum tank 46 and the working chamber 42*a* of the second valve actuator 42 so as to close the stop valve 40 thereby to shut off the flow of air to the inactive cylinders #4 to #6. Accordingly, the engine operation is shifted from the full engine mode into a split engine mode.

At low load conditions, the split engine operating circuit 54 provides a constant change command signal to the injection control circuit 50. It is conventional practice to design the injection control circuit to determine the pulse width of the fuel injection pulse signal with a constant K during a full engine mode of operation and another constant 2K double the constant K during a split engine mode of operation. That is, the amount of fuel supplied to each of the active cylinders #1 to #3 is doubled during a split engine mode of operation. The reason for this is that the amount of air introduced to each of the active cylinders #1 to #3 is doubled due to the closing of the stop valve 40 when the engine operation is shifted from a full engine mode into a split engine mode. With such a conventional design, however, sudden torque changes occur, as shown by diaphragm F of FIG. 2, when the engine operation is shifted between its full and split engine modes.

In order to eliminate such sudden torque changes, the fuel injection control circuit 50 is designed, according to the present invention, to determine the pulse width of the fuel injection pulse signal with a constant K during a full engine mode of operation and with another constant $K_0$ larger than the value 2K double the constant K during a split engine mode of operation so that a somewhat lean mixture can be obtained temporarily when the engine operation is shifted from a split engine mode into a full engine mode and a somewhat rich mixture can be obtained temporarily when the engine operation is shifted from a full engine mode into a split engine mode.

The operation of the present invention will be described further in connection with FIG. 2. Assuming first that the engine operation is shifted from a split engine mode into a full engine mode, as shown by diagram A of FIG. 2, the air/fuel ratio, which has been maintained substantially at the stoichiometric value under the feedback control of the exhaust gas sensor 24, becomes lean, as shown by diagram D of FIG. 2. The constant $K_0$ with which the fuel injection control circuit 50 determines the pulse width of the fuel injection pulse signal during a split engine mode of operation is suitably preset such that the torque is substantially unchanged, as shown by diagram E of FIG. 2, just before and after the engine operation is shifted into the full engine mode.

Figure 2:
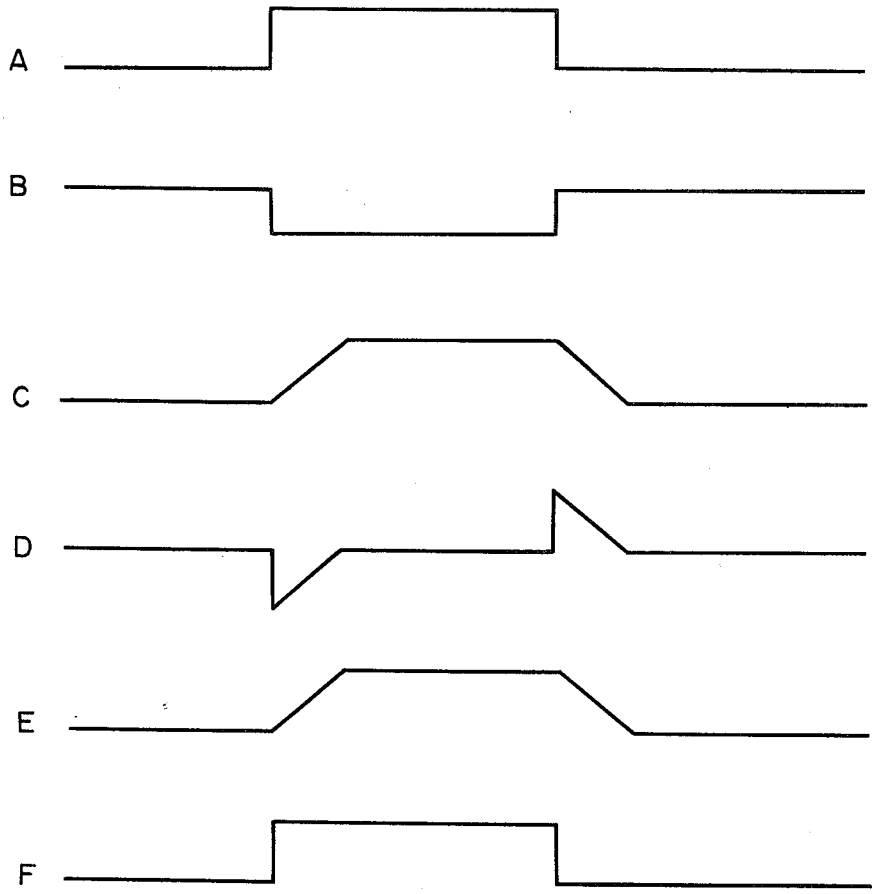
FIG. 2 is a timing charge used in explaining the operation of the present invention.

Thereafter, the air/fuel ratio gradually increases and eventually reaches the stoichiometric value in a predetermined time, as shown by diagram D of FIG. 2, under the feedback control of the exhaust gas sensor 24. With the air/fuel ratio increasing, the torque increases gradually and reaches a predetermined value in a predetermined time, as shown by diagram E of FIG. 2.

When the engine operation is shifted from the full engine mode into a split engine mode, as shown by diagram A of FIG. 2, the air/fuel ratio, which has been maintained substantially at the stoichiometric value under the feedback control of the exhaust gas sensor 24, becomes rich, as shown by diagram D of FIG. 2. The smaller constant with which the fuel injection control circuit 50 determines the pulse width of the fuel injection pulse signal during a split engine mode of operation is suitably preset such that the torque is substantially unchanged, as shown by diagram E of FIG. 2, just before and after the engine operation is shifted into the split engine mode.

Following this, the air/fuel ratio gradually decreases and eventually reaches the stoichiometric value in a predetermined time, as shown by diagram D of FIG. 2, under the feedback control of the exhaust gas sensor 24. With the air/fuel ratio decreasing, the torque decreases gradually and reaches a predetermined value in a predetermined time, as shown by diagram E of FIG. 2.

The rate of change of the air/fuel ratio resulting from the feedback control of the exhaust gas sensor 24 should be properly selected with taking feedback control response time into account so that any hunting can not occur. In such a manner, the torque can not suddenly change, but gradually varies so that no shock occurs in the engine when the engine operation is shifted between its full and split engine modes.

In FIG. 2, diagram B shows occurrence of the constant change command signal and diagram C shows variations in an air/fuel ratio indicative signal from the exhaust gas sensor.

Although the air/fuel ratio deviates from the stoichiometric value temporarily when the engine operation is shifted between its full and split engine modes, it is to be understood that the deviating time is not so long and have no effect upon exhaust gas purifying performance of the catalytic converter 24.

As described above, the fuel injection control circuit 50 is adapted to determine the pulse width of the fuel injection pulse signal with a constant K during a full engine mode of operation and with another constant $K_0$ larger than the value 2K double the constant K during a split engine mode of operation, thereby resulting in a somewhat lean mixture temporarily when the engine operation is shifted from a split engine mode into a full engine mode and a somewhat rich mixture temporarily when the engine operation is shifted from a full engine mode into a split engine mode. Accordingly, no sudden engine torque change and thus no engine shock occurs when the engine operation is shifted between its full and split engine modes.

While the present invention has been described in connection with a six cylinder engine, it is to be noted that the particular engine shown in only for illustrative purposes and the structure of this invention could be readily applied to any split engine structure. While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units, each said units including at least one cylinder;

(b) an intake passage having disposed therein a throttle valve and being divided downstream of said throttle valve into first and second branches communicating with said first and second cylinder units, respectively, said second branch having an intake entrance;

(c) a stop valve positioned generally in the vicinity of said intake entrance of said second branch;

(d) an exhaust gas sensor for providing a signal indicative of the air/fuel ratio at which said engine is operating;

(e) fuel supply means for supplying fuel to said first and second cylinder units, said fuel supply means including means responsive to engine loads for determining a basic value of fuel supply amount and means responsive to the air/fuel ratio indication signal from said exhaust gas sensor for correcting said basic value to maintain a desired air/fuel ratio;

(f) control means for cutting off the supply of fuel to said second cylinder unit to shift engine operation from a full engine mode into a split engine mode, and for closing said stop valve to shut off the flow of fresh air to said second cylinder unit, and for providing a low load indication signal when the engine load is below a predetermined value; and (g) wherein said fuel supply means is responsive to the low load indication signal from said control unit for determining said basic value of fuel supply amount to create a mixture having an air/fuel ratio richer than said desired air/fuel ratio, whereby an air/fuel mixture leaner than said desired air/fuel mixture is obtained temporarily when the engine operation is shifted from a split engine mode into a full engine mode and an air/fuel mixture richer than said desired air/fuel mixture is obtained temporarily when the engine operation is shifted from the full engine mode into a split engine mode.

2. An internal combustion engine according to claim 1, wherein said fuel supply means determines the basic value of fuel supply amount from the product of the existing engine load and a first constant during a full engine mode of operation and determines the basic value of fuel supply amount from the product of the existing engine load and a second constant of a value larger than double said first constant during a split engine mode of operation.

3. An internal combustion engine according to claim 1, which further comprises means, responsive to the low load indicative signal from said control means, for recirculating exhaust gases into said intake passage second branch downstream of said stop valve.

* * * * *